US007762914B2

(12) United States Patent
Daniell

(10) Patent No.: US 7,762,914 B2
(45) Date of Patent: Jul. 27, 2010

(54) PING PONG BALL RETRIEVER

(76) Inventor: R. Graham Daniell, 31 S. Rountree St., Metter, GA (US) 30439

( * ) Notice: Subject to any disclaimer, the term of this patent is extended or adjusted under 35 U.S.C. 154(b) by 18 days.

(21) Appl. No.: 12/004,522

(22) Filed: Dec. 20, 2007

(65) Prior Publication Data

US 2009/0163302 A1 Jun. 25, 2009

(51) Int. Cl.
*A63B 67/04* (2006.01)

(52) U.S. Cl. ..... 473/459; 473/496; 473/475

(58) Field of Classification Search ..... 473/459, 473/460, 475, 496, 465; 273/342
See application file for complete search history.

(56) References Cited

U.S. PATENT DOCUMENTS 3,136,548 A * 6/1964 Engle ..... 273/123 R
3,671,040 A * 6/1972 Meyer et al. ..... 473/473
4,429,868 A * 2/1984 LeBlanc et al. ..... 482/148
4,457,513 A * 7/1984 Thompson ..... 473/469
D279,911 S * 7/1985 Thompson ..... D21/305
4,573,933 A * 3/1986 Cameron ..... 441/16
5,207,432 A * 5/1993 Miller ..... 473/465
D343,754 S * 2/1994 Pierce et al. ..... D6/601
5,529,016 A * 6/1996 Lonsway ..... 119/707
5,575,471 A * 11/1996 Robinson et al. ..... 473/475
5,967,911 A * 10/1999 McAvoy ..... 473/435
2005/0159251 A1* 7/2005 Houston et al. ..... 473/459

FOREIGN PATENT DOCUMENTS

FR 2623093 A1 * 5/1989

* cited by examiner

*Primary Examiner*—Raleigh W. Chiu
(74) *Attorney, Agent, or Firm*—Christopher Smyth

(57) ABSTRACT

Various devices for controlling errant ping pong balls during play are disclosed. A first embodiment may be construed as a device, positioned underneath a ping pong table, the device comprising a plurality of faces extending vertically from the ground and meeting at an apex to form a pyramid. Errant ping pong balls become deflected upon striking the plurality of faces.

6 Claims, 5 Drawing Sheets

PING PONG BALL RETRIEVER

FIELD OF THE INVENTION

The present invention relates to the game of ping pong, and more generally relates to ping pong equipment.

BACKGROUND SECTION

The game of ping pong, or table tennis, is played throughout the world, both leisurely and competitively. A fundamental element of the game is the ping pong table, which, in very general terms, is comprised of a level playing surface elevated some distance off the ground and a net that splits the playing surface into two equal sides. Tables geared towards the leisure market are typically constructed of metal frames, with metal legs, and are often collapsible for storage. Tables geared towards competitive play may be constructed of similar metal frame technology, or, in some cases, with a solid base.

A well known frustration to the sport is loose ping pong balls. Because of their lightweight design and bounce they can easily become errant and a frustration to the players to corral. As is often the case, errant ping pong balls find their way underneath the playing surface. To retrieve the balls one must often crouch down below the table to retrieve the balls. In both leisure and competitive play this is a well-recognized nuisance.

There exist attempts at resolving this problem. One such attempt is a table skirt that is comprised of a cloth-like, stretchable material that attaches below the playing surface and extends down to the ground, around the frame of the table. This provides for a closed surface, from table to floor, on all four sides of the table thus preventing errant balls from entering the air space below the table. This approach, however, comes with significant cost, that heretofore, aside from isolated competitive environments, has not been accepted by the marketplace. Secondly, in the leisure market, where a variety of metal frame tables exist, the skirt approach becomes problematic, as custom-shaped skirts are necessary. Thus, cost becomes an issue again. Third, installing the skirt can be a challenge particularly to a metal frame table.

There exists a need in the marketplace to resolve the well-known dilemma of errant ping pong tables below the playing surface. The solution should be cost-effective, practical, and user-friendly, particularly when geared towards the leisure market.

SUMMARY

Various devices for controlling errant ping pong balls during play are disclosed. A first embodiment may be construed as a device, positioned underneath a ping pong table, the device comprising a plurality of faces extending vertically from the ground and meeting at an apex to form a pyramid. Errant ping pong balls become deflected upon striking the plurality of faces.

BRIEF DESCRIPTION OF THE DRAWINGS

The accompanying drawings incorporated in and forming a part of the specification, illustrate several aspects of the present invention, and together with the description serve to explain the principles of the invention.

DETAILED DESCRIPTION

In the following description, for purposes of explanation, numerous specific details are set forth in order to provide a thorough understanding of the present invention. It will be evident, however, to one skilled in the art that the present invention may be practiced without these specific details.

Figure 1B:
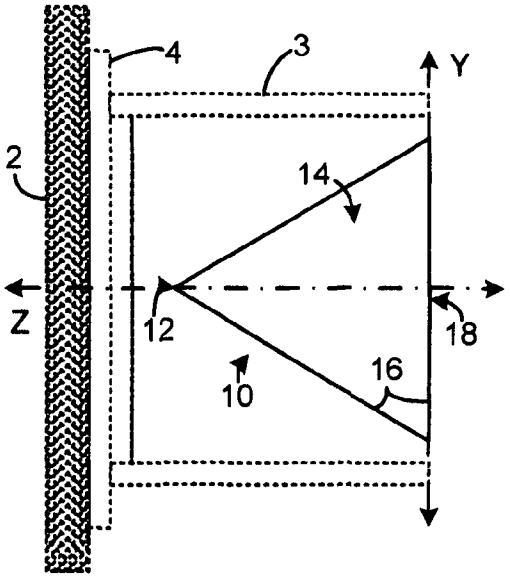
FIGS. 1A-C illustrate an overhead view and side views of a first embodiment of the present invention.
Figure 1A:
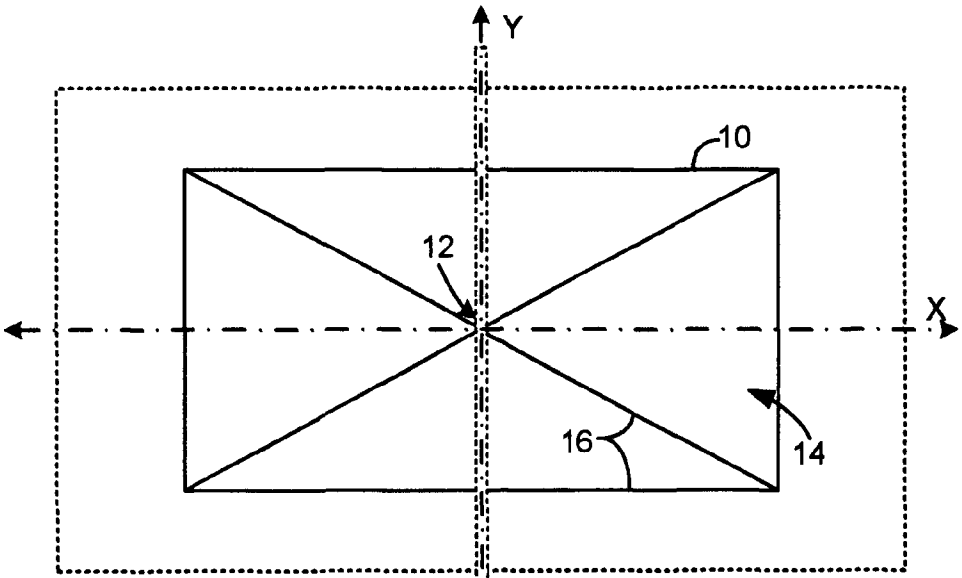
Figure 1C:
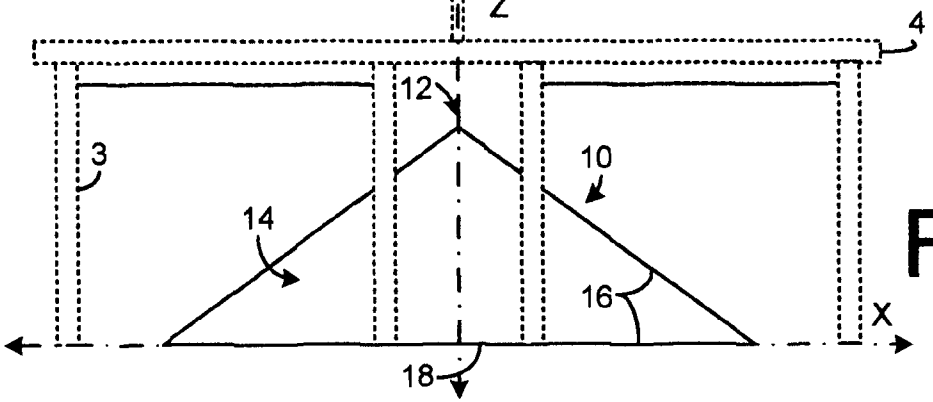

Turning now to FIGS. 1A-C, illustrated are an overhead view and side views of a first embodiment of the present invention. The first embodiment of the invention is a device 10 positioned below a ping pong table 1. Ping pong table 1 is constructed of a playing surface 4 sitting atop legs 3 of the table 1. A net 2 is positioned atop and equally dividing the playing surface 4. As is known in the sport of ping pong, each side of the playing surface 4 is the territory of one player, in the case of single's play, and two players, in the case of double's play.

In this embodiment a single device 10 is centered about the table 1 in both the X and Y directions. In other embodiments, the device 10 could be positioned offset in either direction. In yet other embodiments, two (or more) devices 10 could be positioned underneath the playing surface 4 centered about each player's half.

The device 10 is not, generally speaking, to scale but does illustrate a rectangular base shape mirroring the general dimensions of the ping pong table 1. As will be illustrated in other embodiments, the device 10 could be other shapes with differing dimensions and still embody the principles of the invention.

The device 10 takes on a pyramid shape with triangular faces 14, each meeting at an apex 12. In this embodiment the faces 14 are not symmetrical in size and shape. Each face 14 shares an edge 16 with another face 14. The edges 16 that end at the apex 12 are generally defined as the relatively vertical edges.

In this embodiment, the device 10 includes a base 18 that may sit atop the ground and may or may not be affixed to the ground. The base 18 shares an edge 16 with each face 14. In other embodiments, the device 10 may not include a base 18 as part of the device 10. In such a case, the faces 14 will rest atop the ground.

In this embodiment, the device 10 is formed in such a manner that the four faces 14 are positioned to provide a closed-structure that defines a closed volume (in this instance, of air). In the case where the device 10 does not include a base 18, the device 10 would still be defined as "closed" if the faces 14, in conjunction with the ground form a closed volume.

The device 10 can be constructed of a wide variety of materials, each providing varying degrees of effectiveness, durability, cost of manufacture, ease in packaging and shipping, and other factors. Some, non-limiting, examples of materials in which the device 10 can be constructed are: corrugated fiberboard, wood, foam, aluminum, and plastic. In the case of materials such as corrugated fiberboard, aluminum, plastic, and plastic, the device 10 can be constructed of one piece, folded or creased as needed, preferably along the edges 16. A variety of attaching means can be utilized to join adjacent faces 14 not sharing a unitary piece of material.

In other embodiments, the device 10 can be formed of a volume of a solid material defined by the various faces 14 and edges 16. Foam, for example, is one type of example material where this approach could be utilized.

In yet other embodiments, the device 10 can be formed by the various faces 14, edges 16, and base 18 and inflated to take shape and enclose a volume of air.

In practice, the device 10 is a useful device during the play of ping pong. As is well known in the art, ping pong balls tend to run errant during play. The lightweight and airy design of ping pong balls is critical for play but also causes the balls to come loose. Often times, an errant ball will enter the air space below the playing surface. In these instances, the ball may continue to run errant and leave the air space below the surface, at which time, a player can easily retrieve the ball. Alternatively, the ball may come to rest underneath the playing surface, thus causing one of the players to fetch it. A player must, generally, bend down under the table surface, reach, and retrieve the ball. This process can be quite cumbersome and, if repeated throughout a match, becomes a nuisance, a tax on the body, and a time drain (particularly during competitive play). Device 10, as described herein, can be placed to fill a considerable portion of the air space (and ground) below the playing surface. As such, an errant ball, when entering the air space below the playing surface, can come in contact with the device 10. The ball would subsequently change direction, and preferably leave the air space below the playing surface, thereby making it easier for a player to retrieve. The nuisance of repeatedly retrieving errant balls below the table, is thus avoided, or at the least, mitigated.

As it will be understood by those skilled in the art, there are a number of approaches to manufacturing and producing a device that embodies the invention and accomplishes its intended goals. All such approaches to manufacture and production shall be included within the scope of the present invention.

FIGS. 2-5 illustrate various embodiments of the present invention. Each of these embodiments can be manufactured and produced in similar approaches as those defined above. Likewise, other approaches of manufacture and production are contemplated.

Figure 2B:
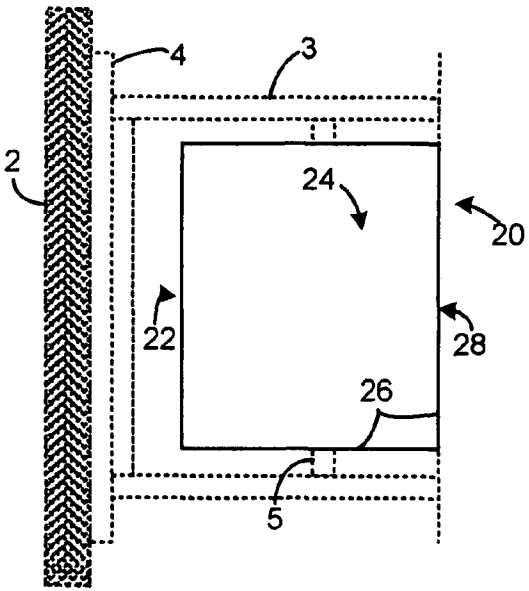
FIGS. 2A-C illustrate an overhead view and side views of a second embodiment of the present invention.
Figure 2A:
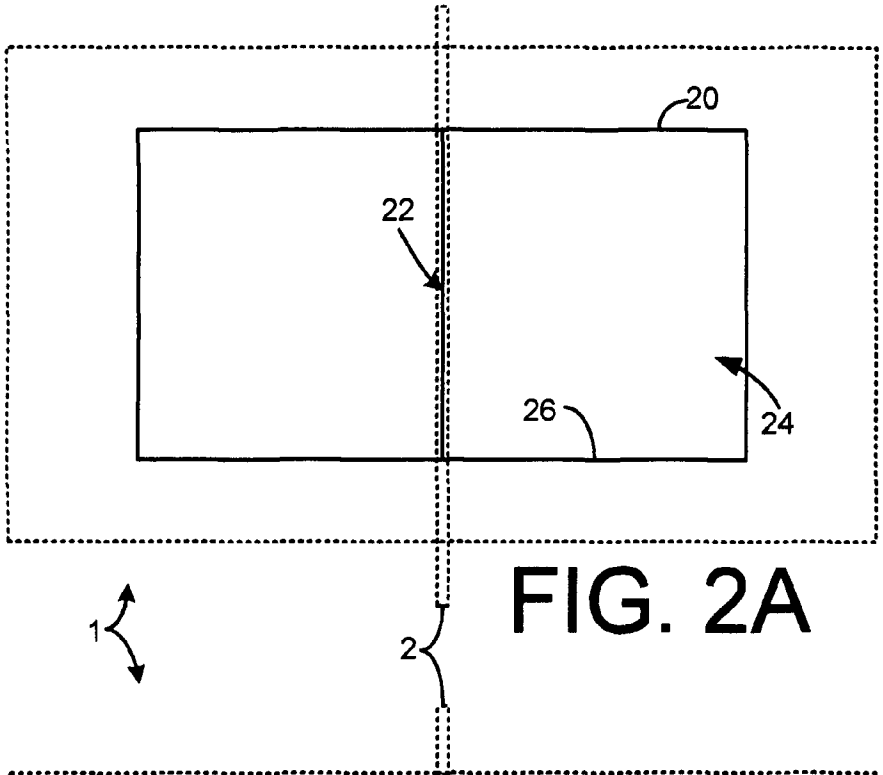
Figure 2C:
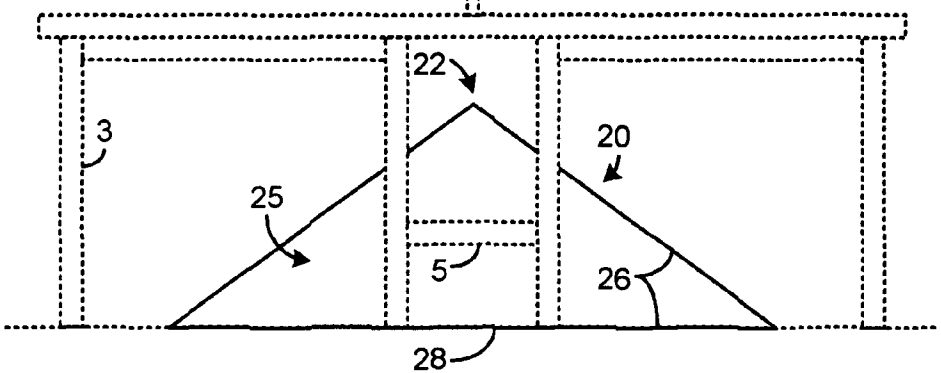

FIGS. 2A-C illustrates an overhead view and side views of a second embodiment of the present invention. Device 20, in this embodiment, includes two sloped faces 24 that meet at a crest 22. Side faces 25, in this embodiment, lies in the X and Z plane, meeting the sloped faces at edges 26. The sloped faces 24 and the side faces 25 can rest atop the ground, or optionally meet base 28 at an edge. As is the case with FIG. 1, the defined shape is a polyhedron that is a three dimensional shape defined by flat faces and straight edges. In the case of FIG. 1, the pyramid shape is a sub-type of the more general polyhedron shape, defined by a polygonal base, an apex, and n-triangular faces connecting the two. There are an infinite number of polyhedron shapes, some more symmetrical then others. It will be appreciated that any polyhedron shaped structure can define the device without departing from the spirit and scope of the present invention.

In the case of the device 20 of FIG. 2, the side faces 25 are optional. If provided, the device shall be considered a "closed" shape, similar to that of FIG. 1, because the volume within the device 20 is generally enclosed by the various faces (including the base 28, or alternatively, the ground surface as an enclosing face in the case where the base 28 is excluded.

Should side faces 25 not be included in the device 20, the shape shall be considered "open" as the volume defined by the device 20 is not fully enclosed. This variation may be desirable in instances where the structure of the table 1 would preclude a closed device 20 from being easily placed. For example, it is not uncommon for a table 1 to include a lateral support member 5 that extends from one side of the ping pong table 1 to the other (best illustrated in FIG. 2B). Member 5 is often used for structural support as well as for storage of playing equipment. In yet other cases, a closed device 20 can be altered, for example, by punching holes in the side faces 25, to allow for the lateral support member 5.

Figure 3B:
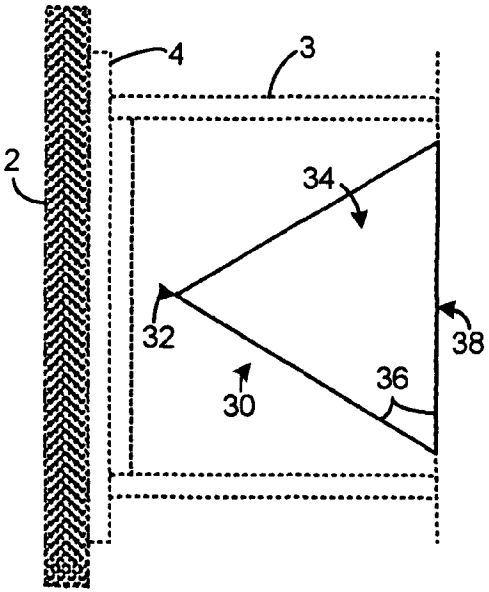
FIGS. 3A-C illustrate an overhead view and side views of a third embodiment of the present invention.
Figure 3A:
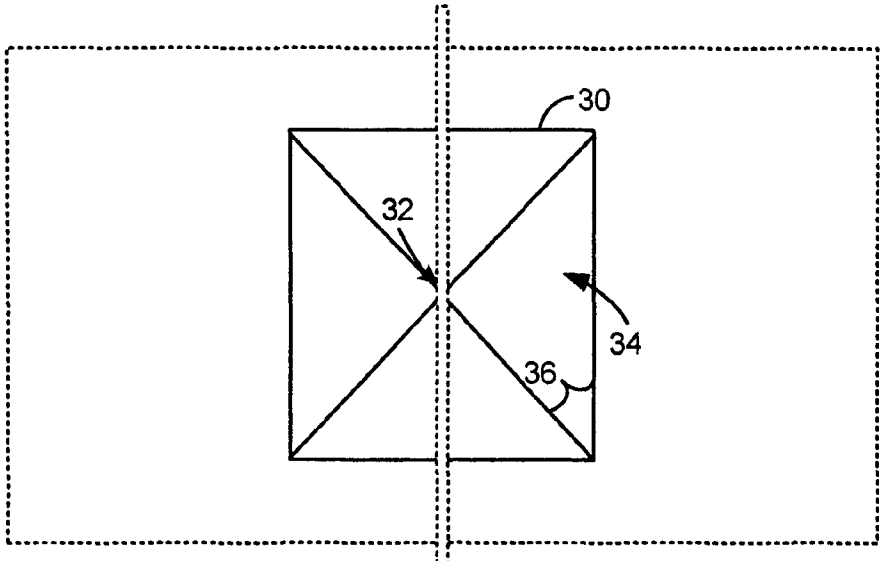
Figure 3C:
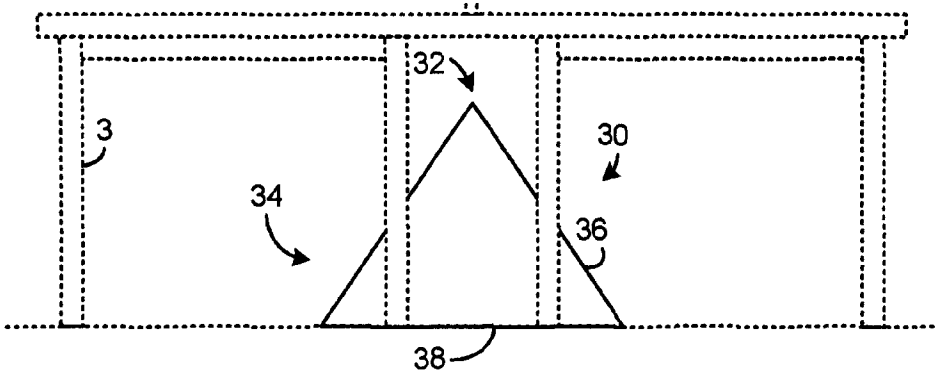
Figure 4B:
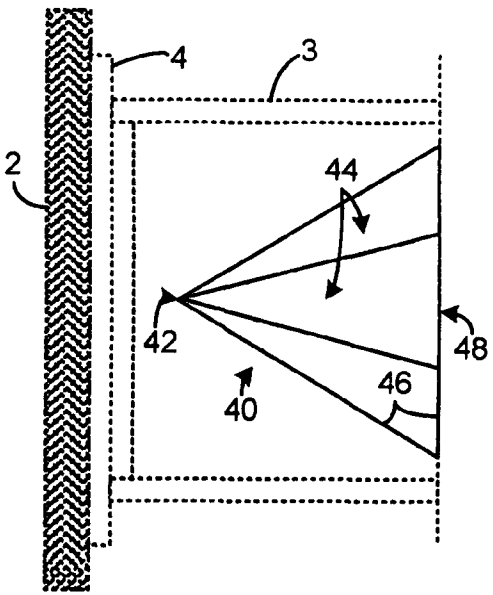
FIGS. 4A-C illustrate an overhead view and side views of a fourth embodiment of the present invention.
Figure 4A:
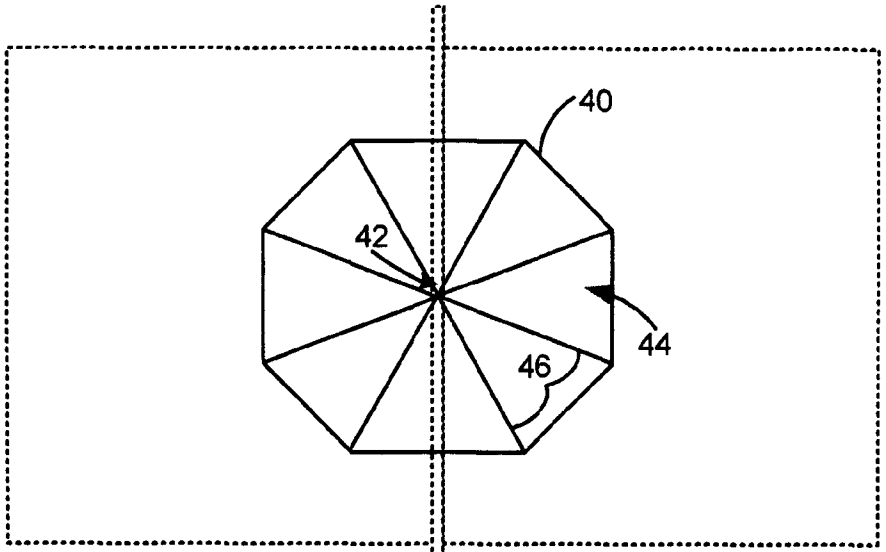
Figure 4C:
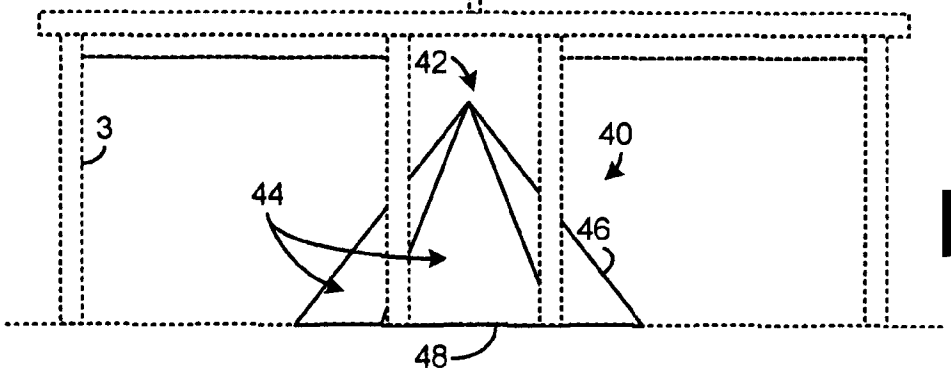

FIGS. 3A-C illustrates an overhead view and side views of a third embodiment of the present invention. The device 30 illustrated in FIGS. 3A-C is similar to the device 10 of FIG. 1, in that it is a pyramid shape. In this embodiment, the device 30 is square pyramid in that all four faces 34 are similar in dimension. FIGS. 4A-C illustrates yet another embodiment. The device 40 is an eight sided pyramid. Eight triangular faces 44 meet at the apex 42. The embodiments disclosed herein are merely for exemplary purposes and shall not be considered limiting in any way.

Figure 5:
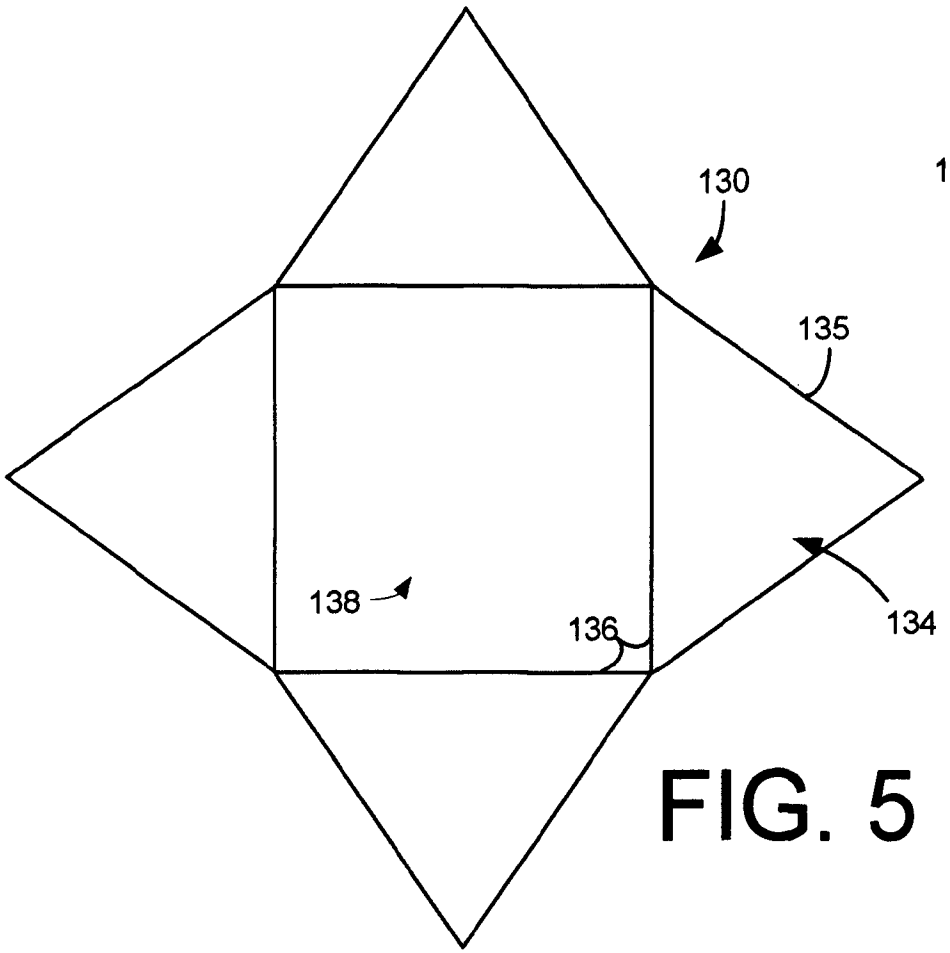
FIG. 5 illustrates a first approach towards assembling an embodiment of the present invention.

FIG. 5 illustrates a first approach towards assembling an embodiment of the present invention. In this case, device 130, when folded to shape takes on the device 30 of FIG. 3. Corrugated fiberboard is the envisioned material from which the device 30 is constructed, in this example. One singular piece of fiberboard is utilized and cut to shape, with the base 138 sharing edges 136 with the four triangular faces 134. Creases can be applied to the fiberboard at the edges 136 during manufacture. The end user can then fold the device 130 to shape. The triangular faces 134 can be affixed to each other at the edges 135 with a variety of means of attachment. Such means of attachment are beyond the scope of the present invention.

This approach offers a simple and cost effective way to manufacture the device 130. It should be understood that this is but one approach towards manufacturing the device 130 using but one example of material. A great variety of approaches, including those aforementioned, as well as materials could be used to manufacture the device 130.

Figure 6:
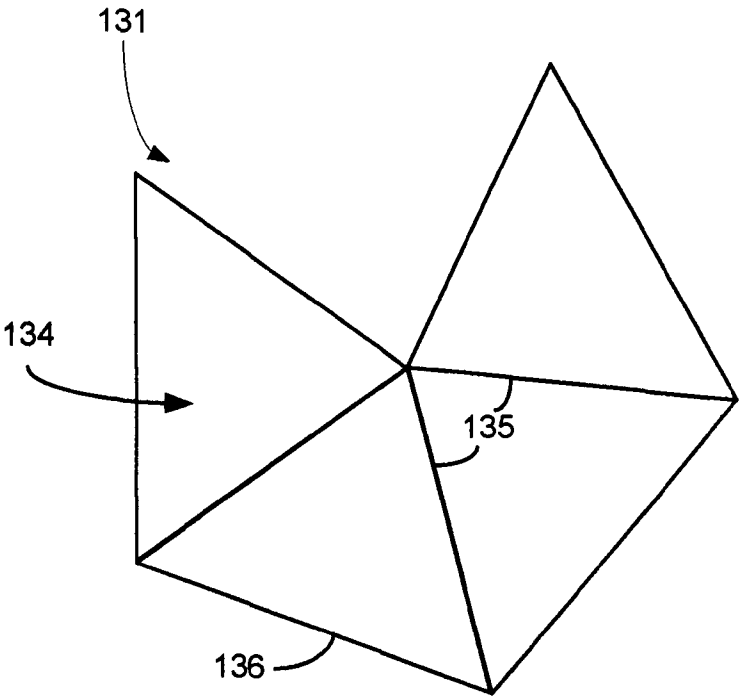
FIG. 6 illustrates a second approach towards assembling an embodiment of the present invention.

FIG. 6 illustrates a second approach towards assembling the device 131. Again, in this example, the envisioned material is corrugated fiberboard. In this case, triangular faces 134 all share one piece of fiberboard. Creases are applied at the vertical edges 135. In this instance, no base is provided. As such, when folded into place, the device 131 would simply rest atop the ground. Upon folding the device 131 to form, the faces 134 all meet.

The invention claimed is:

1. A system comprising:

a ping pong table; and a ping pong ball deflection device positioned below said ping pong table, said device comprising:

a base surface; and a plurality of faces extending vertically from the base surface and meeting at a crest to form a polyhedron-shaped structure, wherein errant ping pong balls become deflected upon striking said plurality of faces.

2. The system of claim 1, wherein said plurality of faces of said deflection device form a closed polyhedron-shaped structure, whereby the volume defined by said faces is relatively enclosed.

3. The system of claim 1, wherein said plurality of faces of said deflection device form an open polyhedron-shaped structure, whereby the volume defined by said faces is relatively not enclosed.

4. The system of claim 1, wherein said base surface and said plurality of faces of said deflection device are constructed of corrugated fiberboard.

5. The system of claim 4, wherein said base surface and said plurality of faces of said deflection device are constructed of one piece of corrugated fiberboard, wherein one edge of each of said plurality of faces is shared with said base surface and each edge is defined by a crease in the corrugated fiberboard.

6. A system comprising:

a ping pong table; and a singular structure, positioned underneath said ping pong table, wherein, upon inflation, encloses a volume of air, said structure comprising:

a base surface; and a plurality of faces extending vertically from the base surface and meeting at an apex to form a polyhedron-shaped structure, wherein errant ping pong balls become deflected upon striking said plurality of faces.

* * * * *